US008884144B2

(12) United States Patent
Martin

(10) Patent No.: US 8,884,144 B2
(45) **Date of Patent: *Nov. 11, 2014**

(54) DRUM MOUNTING AND TUNING SYSTEM PROVIDING UNHINDERED AND ISOLATED RESONANCE

(71) Applicant: August D. Martin, Albuquerque, NM (US)

(72) Inventor: August D. Martin, Albuquerque, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/092,400

(22) Filed: Nov. 27, 2013

(65) Prior Publication Data

US 2014/0298971 A1 Oct. 9, 2014

Related U.S. Application Data

(63) Continuation of application No. 13/857,924, filed on Apr. 5, 2013, now Pat. No. 8,629,340.

(51) Int. Cl.
*G10D 13/02* (2006.01)

(52) U.S. Cl.
CPC ..... *G10D 13/023* (2013.01)
USPC ..... 84/411 R

(58) Field of Classification Search
USPC ..... 84/411 R, 413
See application file for complete search history.

(56) References Cited

U.S. PATENT DOCUMENTS

| | | | | |
|---|---|---|---|---|
| 1,212,126 | A | 1/1917 | Canfield | |
| 3,981,220 | A | 9/1976 | Clark | |
| 4,295,405 | A * | 10/1981 | Sleishman | 84/413 |
| 4,448,105 | A | 5/1984 | Cordes | |
| 4,520,709 | A | 6/1985 | Kester, Jr. | |
| 4,660,455 | A | 4/1987 | Jones et al. | |
| 4,714,002 | A | 12/1987 | Cleland | |
| 4,833,964 | A | 5/1989 | Prouty | |
| 4,869,146 | A | 9/1989 | Bonsor | |
| 5,410,938 | A | 5/1995 | Kurosaki et al. | |
| 5,447,087 | A | 9/1995 | Hawes et al. | |
| 5,834,667 | A | 11/1998 | Midkiff | |
| 7,491,877 | B1 | 2/2009 | Cherny | |
| 8,188,355 | B2 | 5/2012 | Tochilin | |
| 8,629,340 | B1 * | 1/2014 | Martin | 84/411 R |
| 2007/0283797 | A1 | 12/2007 | Crawford et al. | |
| 2009/0038465 | A1 | 2/2009 | Whalley et al. | |

OTHER PUBLICATIONS

International Search Report and Written Opinion for PCT/US2014/032867, Aug. 15, 2014, 17 pages.

* cited by examiner

*Primary Examiner* — Kimberly Lockett
(74) *Attorney, Agent, or Firm* — Los Angeles Patent Group; Arman Katiraei

(57) ABSTRACT

Some embodiments provide a drum structural framework comprising a top shell mount, bottom shell mount, rod holders, and tension rods. The top shell mount and bottom shell mount are mounted to either ending edge of a drum shell disposed between the two mounts. A first set of the rod holders are coupled to the top shell mount and an aligned second set of the rod holders are coupled to the bottom shell mount. The tension rods link the two sets of rod holders without hindering resonance of the drum shell. Tuning assemblies on the rod holders adjust the distance separating the top shell mount from the bottom shell mount, thereby controlling the force imposed on the drum shell. Each rod holder includes one or more dampeners that isolate energy passing from the drumhead to the shell from also reverberating throughout the structural framework of the tension rods and rod holders.

20 Claims, 14 Drawing Sheets

DRUM MOUNTING AND TUNING SYSTEM PROVIDING UNHINDERED AND ISOLATED RESONANCE

CLAIM OF BENEFIT TO RELATED APPLICATIONS

This application is continuation of the United States non-provisional application Ser. No. 13/857,924, entitled "Drum Mounting and Tuning System Providing Unhindered and Isolated Resonance", filed Apr. 5, 2013. The contents of application Ser. No. 13/857,924 are hereby incorporated by reference.

TECHNICAL FIELD

The present invention pertains to musical instrument structure and design and, more specifically, to drum structure and design.

BACKGROUND

Artistic expression can be conveyed in any one of several mediums including music. Musical instruments provide the tools with which to express musicality. Drums or percussions instruments in general are one such tool.

Drum structure and design has remained consistent over several generations. This consistent structure and design has preserved the sound quality that initial incarnations of the instrument produced. While standard and commonplace today, the sound produced by drums constructed according to the conventional structure and design is one that is deadened or muted. This is because of structural features that are integrated into the drum shell that impede the shell's ability to resonate and produce a full and rich sound.

FIG. 1 illustrates drum structure and design common in the prior art. The drum is composed of a pair of drum hoops or rims, a shell, a set of lugs, and a corresponding set of lug holders attached across the side of the drum shell.

The interior of each hoop contains the drumhead. The drumhead is the contact surface that vibrates when stricken during play. For a typical drum, the drumhead on the top side of the drum, sometimes called the batter head, is the part of the drum that a drummer strikes when playing the instrument. The drumhead on the bottom side of the drum provides resonance and is usually thinner than the drumhead on the top side.

Tuning assemblies on the drum hoop can be used to adjust the tension on the drumhead, thereby tuning the drumhead sound and also allowing different drumheads to be coupled to the shell mount. The drum hoop also contains various openings through which the set of lugs can pass through to connect to the corresponding set of lug holders that are attached across the side of the drum shell.

The shell is the body of the drum. It creates much of the sound characteristics of the drum based in part on the resonance of the materials from which the drum shell is constructed. When the drumhead is impacted, the drumhead vibrates. When the drum hoop is tightly coupled to the drum shell using the lug fastening system, the vibrations channel from the drumhead to the containing hoop and are dispersed across the shell. These vibrations then cause the drum shell to resonate which, in turn, produces some of the drum's sound characteristics. Often, the drum shell includes a small hole referred to as the vent hole. The vent hole allows air to escape when the drum is struck, which in turn improves the resonance of the drum.

However, conventional drum structure and design as shown by FIG. 1 impedes this resonance. This is due to the attachment of the lug holders 110 across the drum shell. Specifically, when the lugs are placed into the lug holders and tightened in order to couple the drum hoop to the shell, a force is exerted on the lug holders based on how tightly the lugs are tightened. The force is then borne onto the drum shell along the points at which the lug holders are connected to the shell. This force pulls the drum shell in at least one direction, preventing the drum shell from fully resonating in the opposite direction(s), and thereby deadening or muting the overall sound produced by the drum.

Conventional drum structure and design further hinders the sound that can be produced by the drum by limiting the current manufacturing and production of the drum shell to dense materials such as metal (e.g., steel or brass), wood (e.g., birch, maple, oak, etc.), and acrylic as some examples, to thicker construction, or some combination of both. The density of the drum shell material and thickness of the drum shell are needed to prevent the drum shell from warping or breaking when absorbing and counteracting the forces imposed by the tensioning of the lugs from the drum hoop to the lug holders attached along the side of the drum shell. This results in a lot of force on the drum shell. It is for this reason that some shells are manufactured with a thickness of up to 20 millimeters. In these instances, more energy is needed to induce resonance from such shells. Also, the density and thickness causes the drum shell to vibrate at a higher intrinsic frequency. Accordingly, the sound profile produced by the drum is defined and limited to the resonate characteristics that these dense or thicker materials provide. The full potential spectrum of a drum shell's sound is unattainable unless a drum shell of reduced thickness or less dense materials are used in the drum shell composition and the drum shell is allowed to resonate freely. Both of these attributes would require less sound energy from a stricken drumhead to generate resonation from a drum shell. Thus, this would provide a drum a more efficient resonating sound profile.

In an attempt to remedy some of these shortcomings, alternative drum designs have been proposed. One such alternative design is provided in U.S. Pat. No. 5,410,938. The provided design frees the resonance of the drum shell by use of tension rods that span from the top side drum hoop (i.e., batter side) to the bottom side drum hoop and by coupling the rod holders to the hoops instead of the drum shell. This design improves the potential resonate characteristics of the drum shell, but does so by imposing other tradeoffs in the sound quality of the drum. Specifically, this design produces a distorted and impure sound because vibrations from the drumhead disburse not only across the drum shell but also into each of the tension rods. Consequently, the tension rods absorb vibrations each time the drumhead is struck causing the tension rods to produce additional undesired sounds (i.e., rattling) along with the expected drum sound. These undesired sounds are the result of a failure to isolate the mounting or tuning mechanisms (i.e., tension rods and rod holders) from the sound producing elements of the drum (i.e., drumhead and shell).

Accordingly, there is a need for a new drum structure and design that provides pure and unimpeded sound by allowing the drum shell to resonate freely without distortion or dampening from mounting or tuning mechanisms attached across the side of the drum shell. In other words, there is a need for a new drum structure and design wherein the supporting framework couples together the sound producing elements of the drum in a manner that shields the sound energy emanating from the sound producing elements from the supporting framework. By addressing these needs, one can produce a drum with unparalleled sound. Drum design can further improve the sound profile of the drum by addressing the need to reduce the forces that are imposed on the drum shell. In so doing, such a design would allow for shells constructed from thinner materials to be incorporated into the drum construction with the drum shell offering greater resonance and different sound characteristics than their thicker or more dense counterparts.

SUMMARY OF THE INVENTION

It is an objective to provide a drum structural framework that disburses energy from the drumhead to a freely resonating drum shell while reducing or completely isolating the same energy from reverberating throughout the structural framework. It is therefore an objective to provide a drum structural framework that achieves a pure drum sound profile in which the resonance of the drum shell is unimpeded and distortion and other undesired sounds from the structural framework are eliminated.

These and other objectives are achieved by the ultimount structural framework of some embodiments. The ultimount structural framework is comprised of a top shell mount, bottom shell mount, rod holders, and tension rods. Unique to the ultimount rod holders is the integrated dampening solution that contains the energy imposed during play on the sound producing elements while reducing or completely isolating that same energy from reverberating through the non-sound producing elements of the structural framework.

The top shell mount comprises a die-cast hoop, a bearing edge ring, and a tension ring. The top shell mount secures and tunes a first drumhead of the drum to the drum shell without hindering resonance of the drum shell. The bottom shell mount comprises a complementary die-cast hoop, bearing edge ring, and tension ring that secures and tunes a second drumhead also without hindering resonance of the shell. Specifically, a first set of the rod holders are coupled to the top shell mount and an aligned second set of the rod holders are coupled to the bottom shell mount. The tension rods link the first set of the rod holders to the corresponding second set of rod holders. Tuning assemblies on the rod holders can be used to adjust the distance separating the top shell mount from the bottom shell mount, thereby controlling the compression force imposed on the drum shell. The compression force holds the drum shell in place without hindering resonance of the drum shell, because the drum shell itself is only contacted along its top and bottom distal edges by the underside of the top shell mount and the bottom shell mount. The free resonance of the drum shell produces a richer and fuller sound profile as compared to other designs in which extraneous forces placed on the drum shell deaden the sound by obstructing the resonance of the drum shell. These extraneous forces typically manifest when lug holders or other forces are disposed along the side of the drum shell. An additional undesired byproduct of these extraneous forces is the need for a thicker drum shell. The greater the thickness of the drum shell, the greater the amount of energy needed to induce resonance and produce sound. However, since the design advocated herein removes any such extraneous forces from the drum shell, thinner drum shells or drum shells using less dense materials that were previously inapt, such as plastic, clay, and glass, can now be used. Consequently, a new evolution in drum sound is opened.

Moreover, each rod holder couples to either the top shell mount or bottom shell mount with one or more isolation rings that serve as vibration dampeners. The dampeners isolate energy passing from the drumhead to the drum shell from also reverberating throughout the structural framework of the tension rods and rod holders holding together the drumhead and drum shell. This prevents the tension rods and other structural framework elements from vibrating or creating other undesired sound or reverberation that would otherwise pollute the sound profile of the drum.

BRIEF DESCRIPTION OF THE DRAWINGS

In order to achieve a better understanding of the nature of the present invention a preferred embodiment of the ultimount structural framework will now be described, by way of example only, with reference to the accompanying drawings in which.

DETAILED DESCRIPTION OF THE INVENTION

Figure 1:
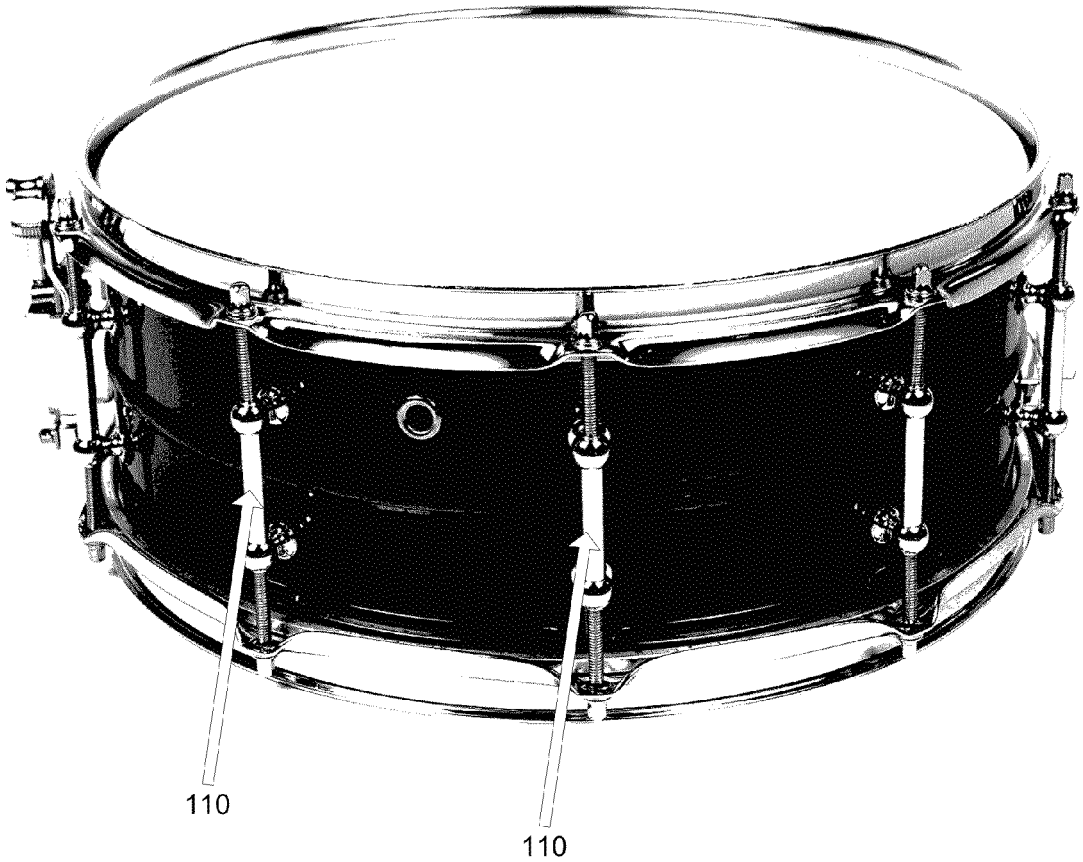
Prior Art Figure 1
FIG. 1 illustrates drum structure and design commonplace in the prior art.
Figure 2:
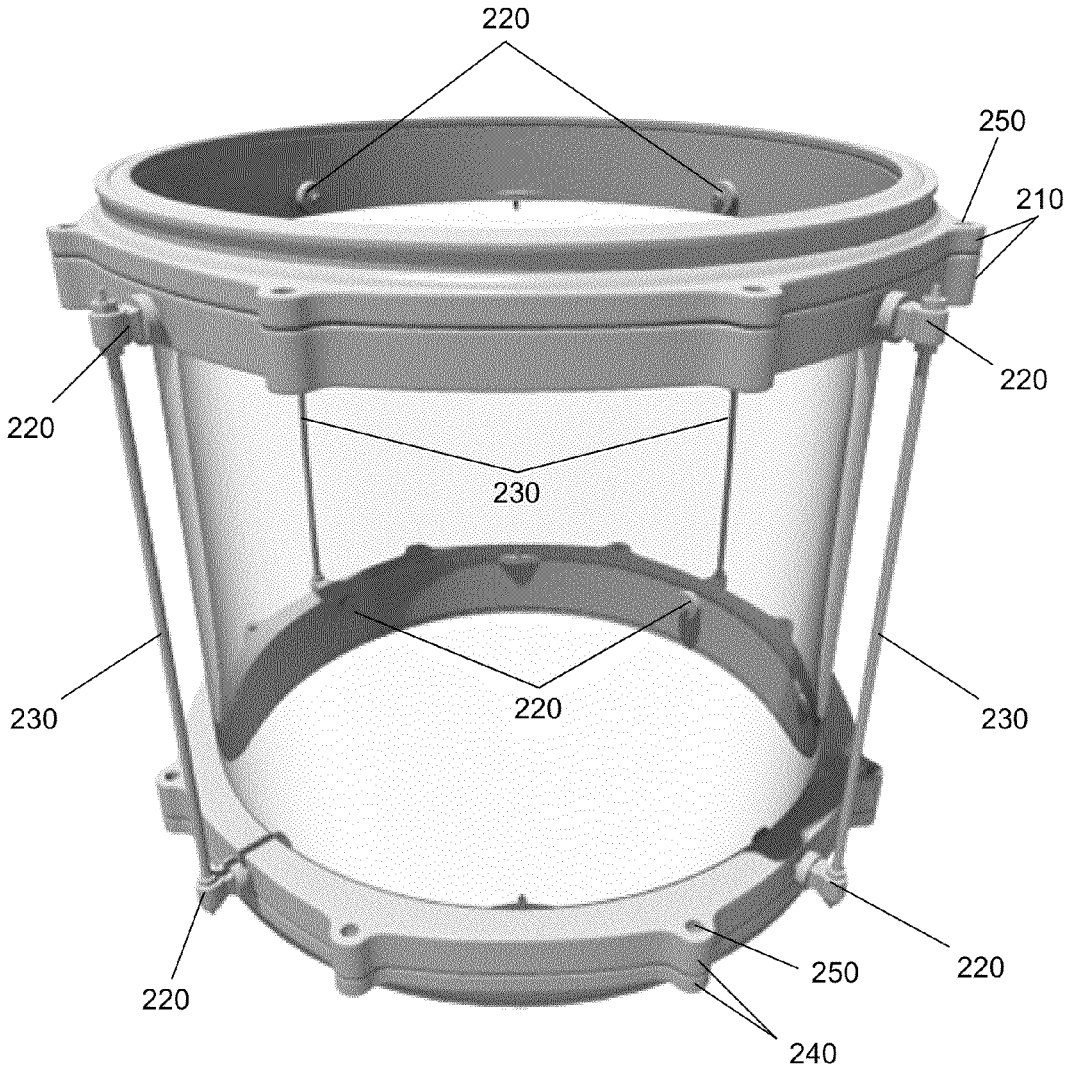
FIG. 2 illustrates the ultimount drum design and structure of some embodiments.

FIG. 2 illustrates the ultimount drum design and structure of some embodiments. In differing from drum designs and structures of the prior art, the ultimount couples the drumhead to the drum shell in a manner that does not hinder resonance of the drum shell and in a manner that isolates the non-sound producing supporting framework from the sound producing drumhead and shell. In so doing, the ultimount provides several advantages over drum designs and structures of the prior art. First, the ultimount provides a richer and fuller sounding drum because the ultimount does not hinder resonance of the drum shell during play. Second, the ultimount eliminates undesired sound and distorted sound from the overall sound profile of the drum because of the isolation of the structural framework from the sound producing elements of the drum. Third, the ultimount allows for the manufacture of entirely new drum shells because the ultimount removes extraneous forces that are imposed on the drum shell by other frameworks, thereby allowing the drum shell to be manufactured with thinner construction and/or less dense materials, thus providing better resonance.

As shown in FIG. 2, the ultimount structural framework includes top shell mount 210, rod holders 220, tension rods 230, and bottom shell mount 240. This structural framework couples the drumhead to the shell. More importantly, this structural framework ensures that sound energy imposed on the drumhead during play is disbursed to an unhindered and freely resonating drum shell without reverberating throughout the structural framework and without causing distorted or undesired sound.

Figure 3:
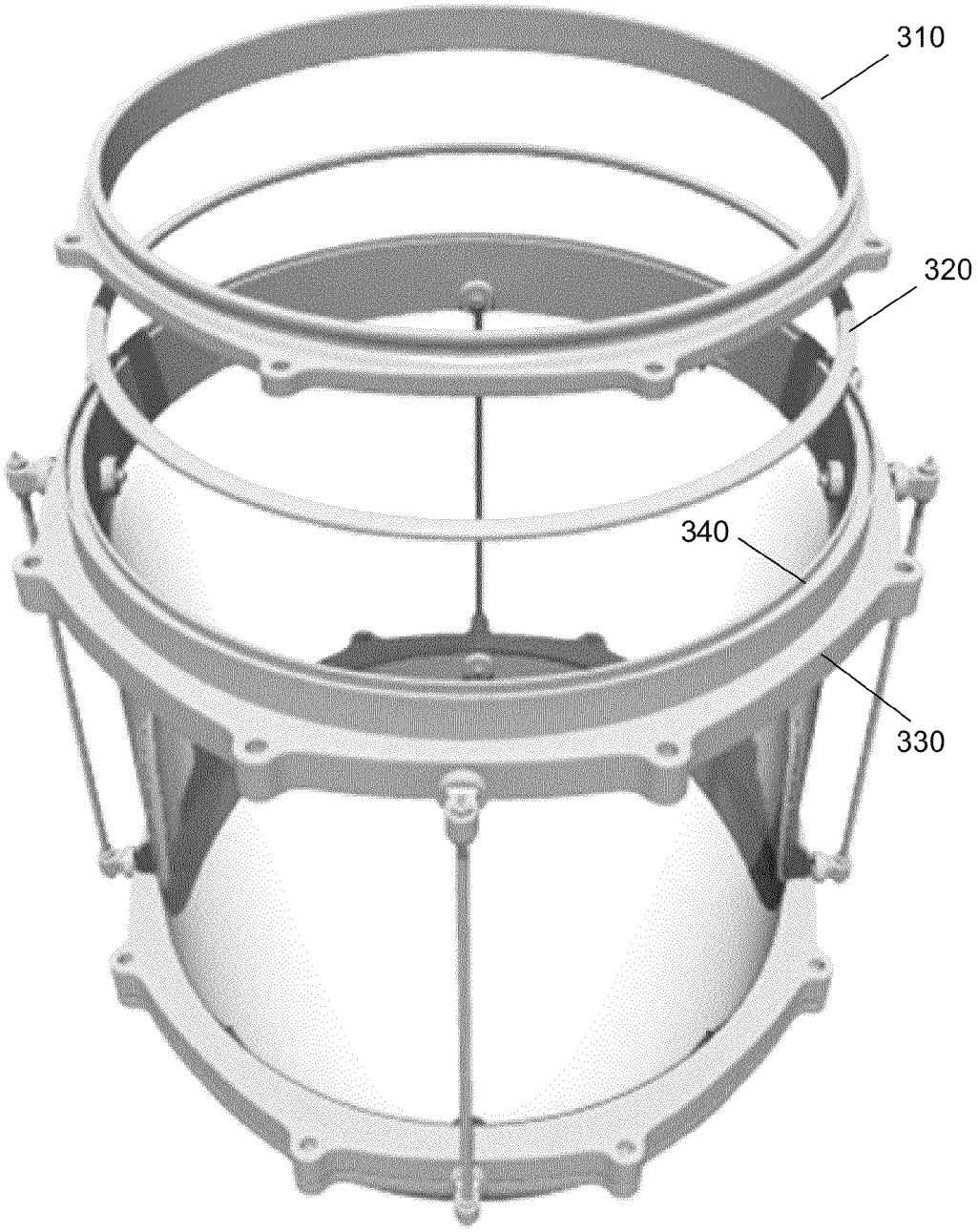
FIG. 3 provides a partially exploded view of the ultimount structural framework to illustrate the die-cast hoop, bearing edge ring, and tension ring of the top shell mount.
Figure 4:
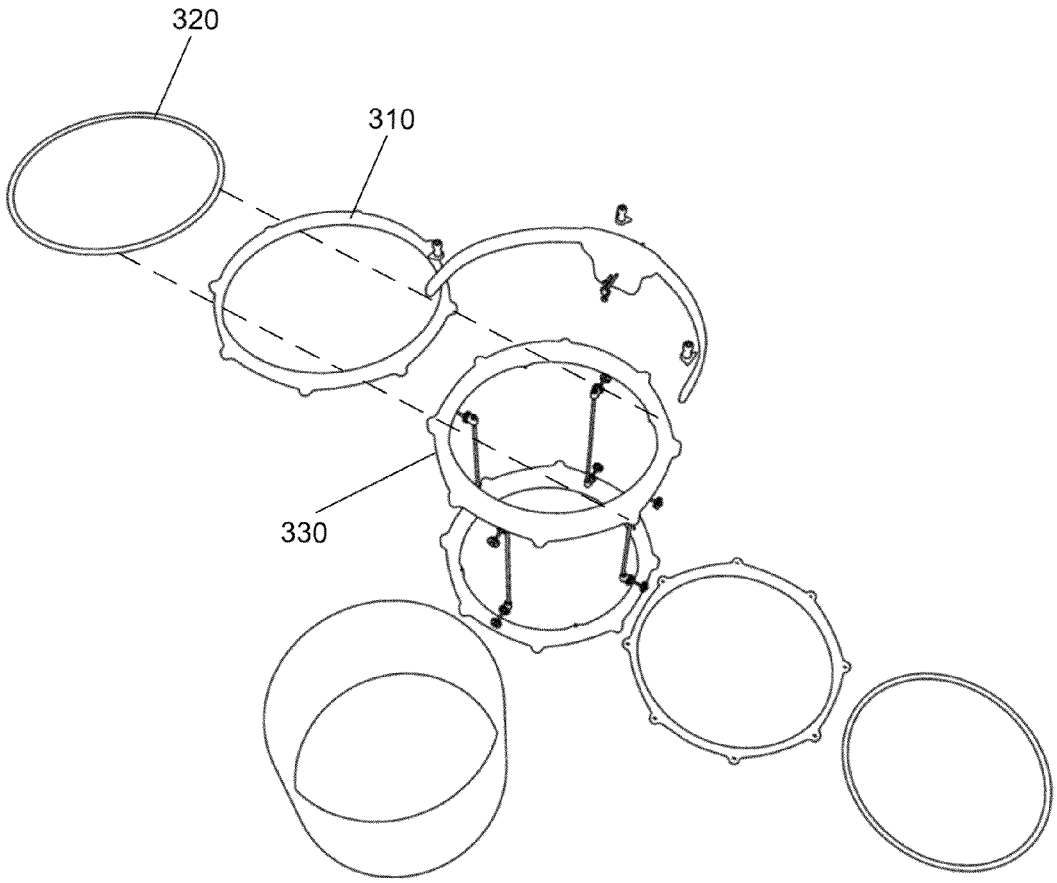
FIG. 4 provides an alternate exploded view illustrating the die-cast hoop, bearing edge ring, and tension ring of the top shell mount.

The top shell mount 210 and bottom shell mount 240 are constructed from a rigid material, such as metal (e.g., brass, steel, etc.) or carbon fiber. Each shell mount 210 and 240 is comprised of a die-cast hoop, a bearing edge ring, and a tension ring. FIG. 3 provides a partially exploded view of the ultimount structural framework to illustrate the die-cast hoop 310, bearing edge ring 320, and tension ring 330 of the top shell mount 210. FIG. 4 provides an alternate exploded view illustrating the die-cast hoop 310, bearing edge ring 320, and tension ring 330 of the top shell mount 210. For simplicity, the die-cast hoop is interchangeably referred to as the upper ring and the tension ring is interchangeably referred to as the lower ring.

The lower ring or tension ring 330 mounts atop the outer lip of the drum shell. The tension ring 330 has a hollowed inner cavity with a recessed groove 340 running centrally along the ring circumference.

Figure 5:
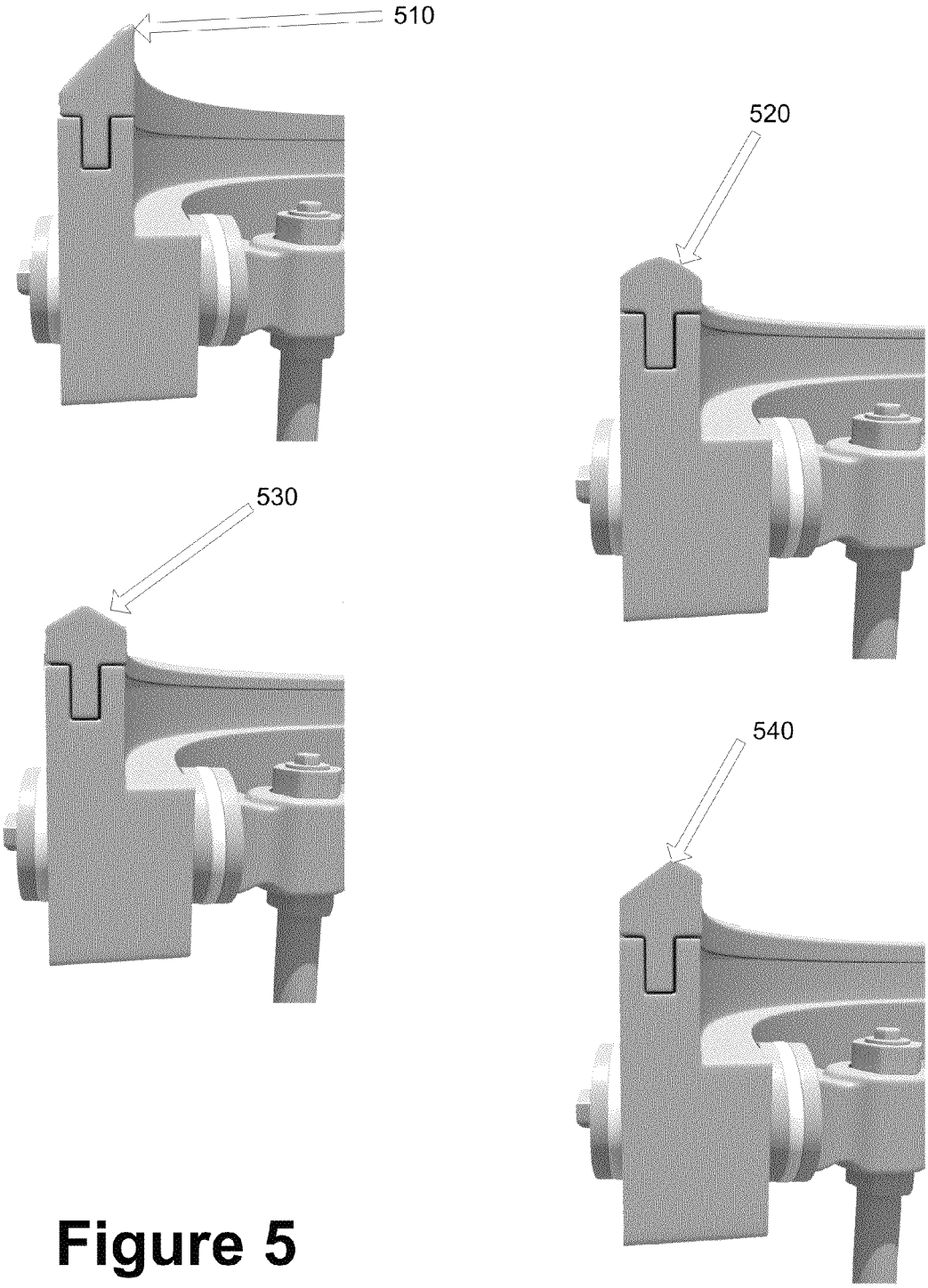
FIG. 5 provides cross sectional views of different bearing edge rings that can be inserted within the tension ring with each bearing edge ring cut at a different angle in accordance with some embodiments.

The bearing edge ring 320 has a downward extruding edge that allows the bearing edge ring 320 to sit within the recessed groove of the tension ring 330 and to aid in precise drum tuning. As such, the bearing edge ring 320 is easily interchangeable, thereby allowing the ultimount framework to accommodate bearing edges that are cut at a variety of angles with each angle changing the tonality of the drum, and more generally, altering the sound profile. Some embodiments provide a bearing edge cut at 30 degrees and other embodiments provide a bearing edge cut at 45 degrees. When the drumhead is disposed atop the 30 degree bearing edge, tuned, and played, the resulting sound has a mellow attack and a low amount of sustain, whereas when the drumhead is disposed atop the 45 degree bearing edge, tuned, and played, the resulting sounds has a lot of attack and a lot of sustain. These angles are provided for exemplary purposes. Accordingly, the ring 320 is not limited to these angles and can be cut at any other angle. FIG. 5 provides cross sectional views of different bearing edge rings 510, 520, 530, and 540 that can be inserted within the tension ring with each bearing edge ring 510, 520, 530, and 540 cut at a different angle in accordance with some embodiments.

The interchangeability of the bearing edge ring 320 within the tension ring 330 provides the user with quick, simple, and cost-effective means with which to alter the sound profile of the drum. The interchangeability also allows a first bearing edge ring cut at a first angle to be inserted within the tension ring of the top shell mount and a second bearing edge ring cut at a second different angle to be inserted within the tension ring of the bottom shell mount. The bearing edge ring 320 can be made of steel, brass, wood, or carbon fiber as some examples.

As noted above, the drumhead is disposed atop the bearing edge ring 320 and the upper ring or die-cast hoop 310 is placed over the drumhead and secured to the tension ring 330. Typically, the die-cast hoop 310 is enlarged relative to the tension ring 330 so as to fit around the outer circumference of the tension ring 330. Tension on the drumhead is adjusted by tightening or loosening a set of screws or lugs that pass through holes along the die-cast hoop 310 and screw into a corresponding set of threaded holes along the outer edge of the tension ring 330. Examples of these threaded holes are illustrated in FIG. 2 by reference markers 250. The tighter the die-cast hoop 310 is secured to the tension ring 330, the greater the force that is exerted on the drumhead. Adjusting this force controls how taut the drumhead becomes, thereby tuning the sound of the drumhead. In some embodiments, a torque wrench can be used to tighten the screws or lugs and thereby achieve a desired level tension on the drumhead. Different drumheads can be inserted between the top shell mount 210 and the bottom shell mount 240. As such, the drum can be played as a "tom" at one end or drumhead at the top side or batter side of the drum and as a "snare" at the other end for example.

Figure 6:
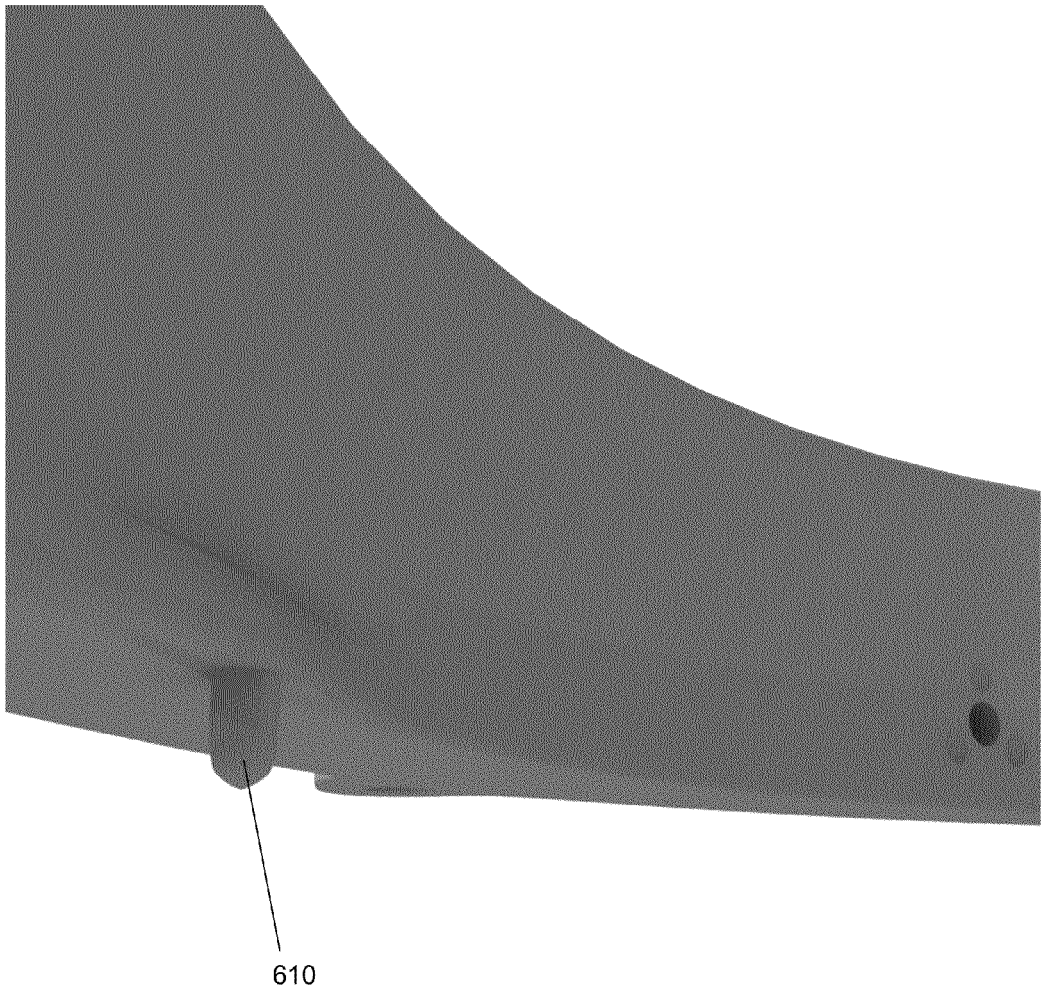
FIG. 6 illustrates a tension ring with at least one guide.

In some embodiments, the tension ring 330 includes one or more guides to aid in coupling the shell mount to the drum shell. FIG. 6 illustrates a tension ring with at least one guide 610. The guide 610 is a protrusion extending from the underside of the tension ring interior. The guides are used to align the tension ring directly over the drum shell by positioning along the interior of the drum shell circumference.

The tension ring 330 or lower ring of each shell mount 210 and 240 serves a dual purpose. As noted above, the first purpose involves coupling with the die-cast hoop 310 to hold and tune the drumhead. The second purpose involves coupling the drumhead to the drum shell in order to disburse sound energy from the drumhead to the drum shell while preventing that same energy from reverberating throughout the structural framework. The sound energy isolation is achieved based on the design and structure with which the vibration is isolated from the rod holders 220 and tension rods 230 coupled to the tension ring 330 of each shell mount 210 and 240.

In some embodiments, the tension ring 330 has a width and height of 5 to 30 millimeters such that when the tension ring 330 is positioned over the end edge of the drum shell, the tension ring 330 extends some millimeters over the plane of the end edge and away from the center of the shell. In some other embodiments, the tension ring 330 extends vertically below the plane of the end edge and towards the center of the drum shell based on a covering that protrudes from the tension ring 330 at a radius greater than that of the shell rim. In either configuration, multiple apertures are drilled across the circumferential face of the tension rings.

With reference back to FIG. 2, a first set of the rod holders 220 couple to the tension ring of the top shell mount 210 at the provided apertures. Similarly, a second set of the rod holders 220 couple to the tension ring of the bottom shell mount 240 at the provided apertures. The rod holders 220 are unique relative to those of the prior art because of their vibration isolating design and structure. The holders 220 reduce or completely isolate energy that is imposed on the drumhead during play from the structural framework holding the drum together and more specifically, from the tension rods 230. This prevents the tension rods 230 from rattling or creating other undesired sound during play.

Figure 7:
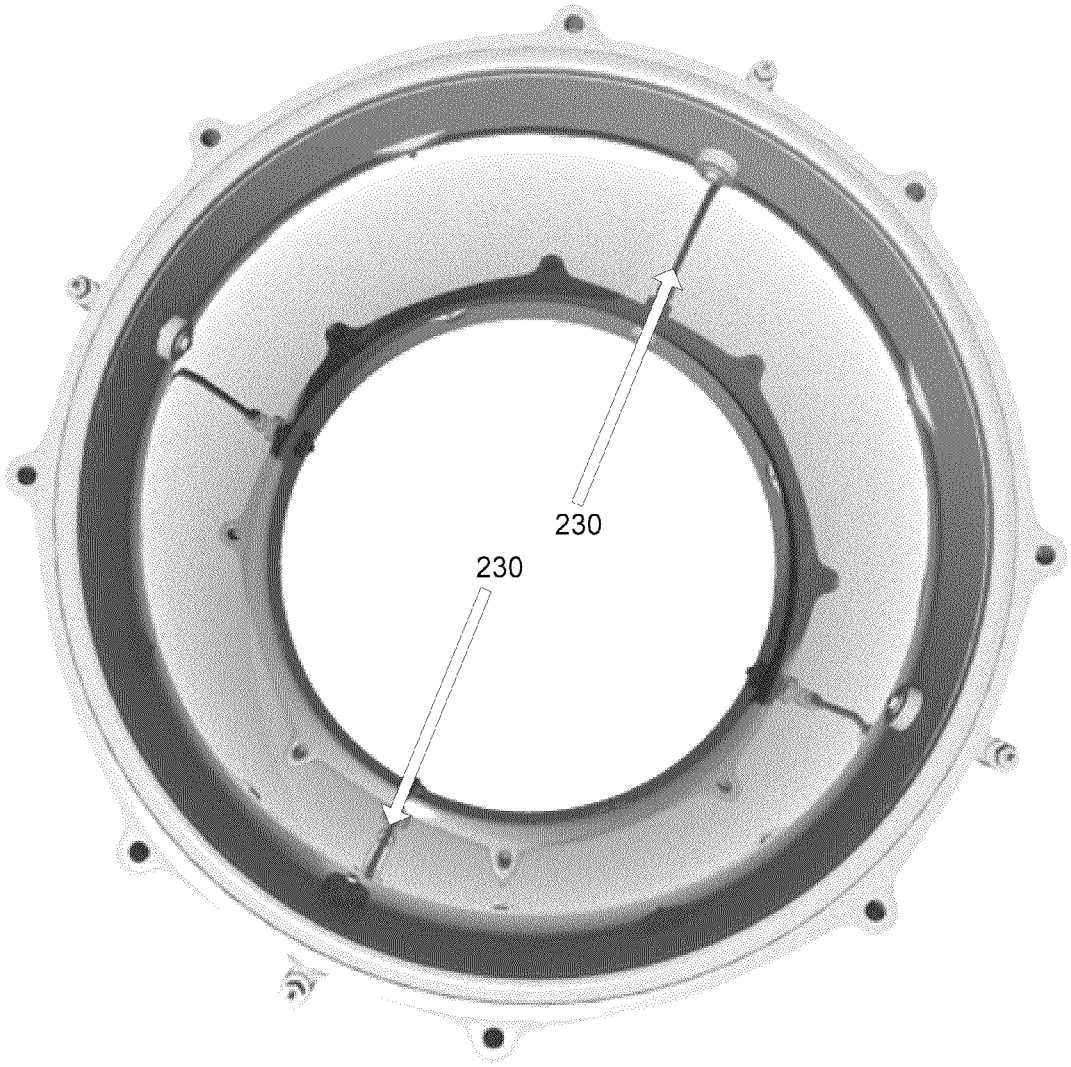
FIG. 7 illustrates the ultimount drum design and structure with a set of interior facing rod holders that dispose the tension rods within the interior of the drum shell.

In the embodiment shown in FIG. 2, the rod holders 220 are exterior facing such that the tension rods 230 span lengthwise along the exterior of the drum shell. However, other embodiments, such as the one depicted in FIG. 7, comprise a structural framework in which the rod holders 220 are interior facing such that the tension rods 230 span lengthwise within the interior of the drum shell.

Figure 8:
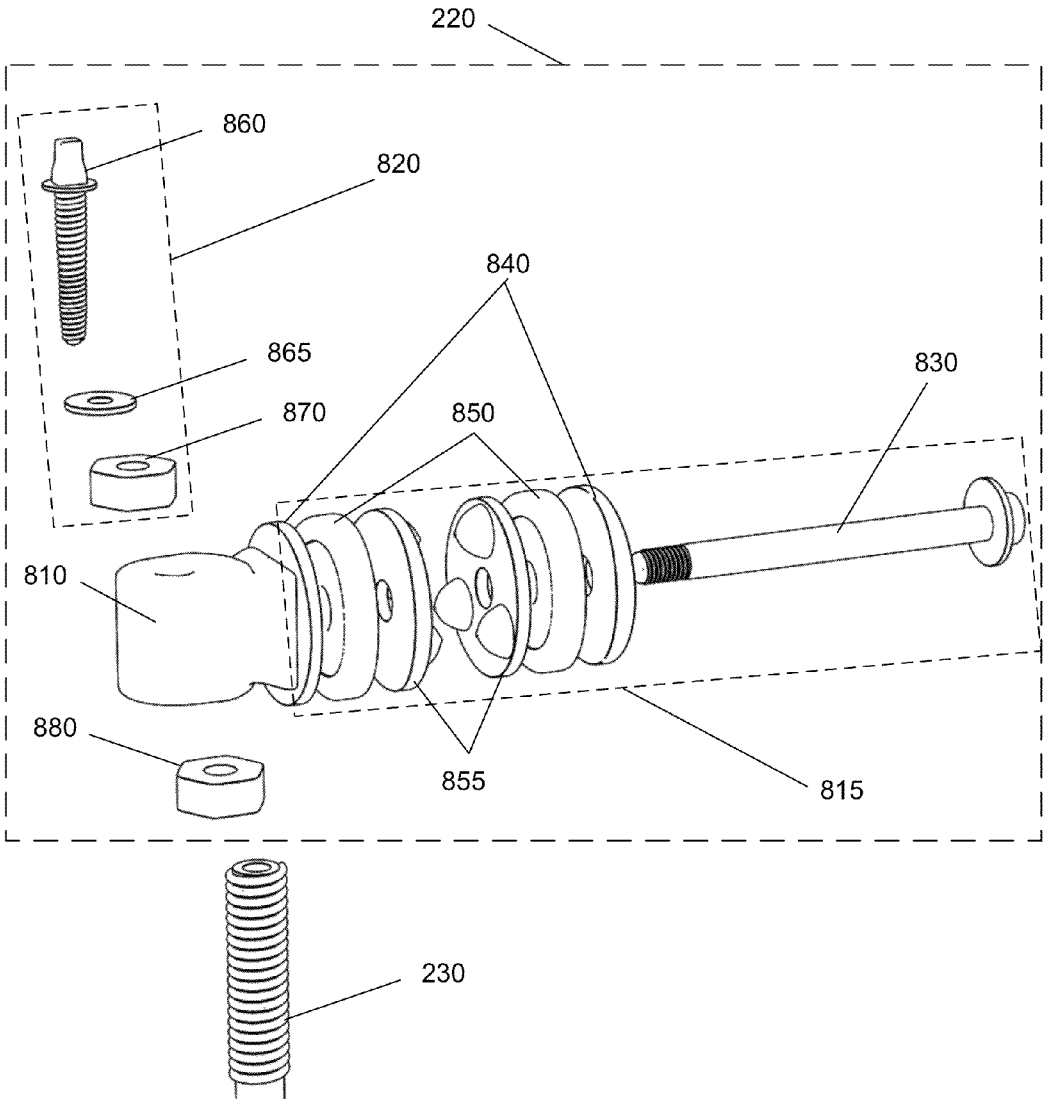
FIG. 8 illustrates an exploded view of a rod holder in accordance with some embodiments.

An exploded view of a rod holder 220 in accordance with some embodiments is provided in FIG. 8 to demonstrate the structural elements that isolate sound energy from reverberating through the ultimount structural framework. As shown, the rod holder 220 is composed of a three faceted binding anchor 810, a vibration dampening assembly 815, and a tension assembly 820.

The three faceted binding anchor 810 includes a horizontal threaded aperture that is used in conjunction with the vibration dampening assembly 815 to secure the rod holder 220 to one of the shell mounts and to isolate the structural framework from the drumhead and drum shell. The three faceted binding anchor 810 also includes bilateral vertical apertures. One end of the bilateral vertical aperture accepts a tension rod 230. The tension rod 230 passes through to the other end where it is then secured using a threaded nut 870 of the tension assembly 820.

The vibration dampening assembly 815 includes a bolt 830, spacers 840, dampeners 850, and gripped endcaps 855. In some embodiments, the endcaps 855 and spacers 840 are made from metal for structural integrity or carbon fiber for high tensile strength. The dampeners 850 are made from absorbing and dampening materials. In some embodiments, the dampeners 850 are isolating rings made of rubber, although other materials such as carbon fiber can also be used. In some other embodiments, the endcaps 855 and spacers 840 are also made from absorbing and dampening materials to compliment the dampening provided by the isolating ring dampeners 850.

The vibration dampening assembly 815 secures the rod holder 220 to one of the shell mounts 210 and 240 and, more importantly, prevents the impact energy that is placed on the drumhead from passing through the ultimount structural framework that holds the drum together. To do so, a gripped endcap 855 is positioned on either side of an aperture along the circumferential face of one of the tension rings. Each gripped endcap 855 includes a set of conical protrusions that minimize the surface contact with the circumferential face of the tension ring. Minimizing the contact surface between the gripped endcaps 855 and the circumferential face minimizes the amount of energy that gets transferred to the structural framework, thereby minimizing the amount of energy that must be dampened within the structural framework. Also, by minimizing the amount of energy that gets transferred to the structural framework, more of the energy is preserved and passed to the drum shell resulting in fuller and less muted sound. In some embodiments, the circumferential face of the tension ring includes a set of recessed guides for the set of conical protrusions of the endcaps 855. A dampener 850 in the form of an isolating ring or bushing is positioned along the opposite side of either gripped endcap 855. Lastly, a spacer 840 is positioned on either side of the dampeners 850. In some embodiments, each of the endcaps 855, dampeners 850, and spacers 840 can be convex or concave in shape depending on whether it is positioned along the interior or exterior of the tension ring.

Each of the endcaps 855, dampeners 850, and spacers 840 have a circular opening in their respective center that is sized to accommodate the bolt 830. Once the elements are positioned, the bolt 830 is passed through each of the elements with the aperture of the tension ring being at the center of the arrangement. The bolt 830 is screwed into the horizontal threaded aperture of the three faceted binding anchor 810. This then secures the rod holder 220 to the tension ring of either the top shell mount 210 or bottom shell mount 240. Furthermore, it establishes the necessary contact to allow the dampeners 850 to absorb and prevent energy from passing into the structural framework.

The endcaps 855, dampeners 850, and spacers 840 are also sized according to the radial height of the tension ring to which they are attached. In some embodiments, the radial height changes based on the drum shell size (or diameter) and the corresponding size of the shell mount that fits the drum shell. The different sized endcaps 855, dampeners 850, and spacers 840 ensure proper dampening by providing sufficient contact between the tension ring and the vibration dampening assembly 815 while avoiding components that are over-sized such that they extend beyond the radial height of the tension or are undersized such that they pass through rather than engage the aperture along the circumferential face of the tension ring. This also ensures that the conical protrusions of the endcaps 855 fit within the recessed guides along the circumferential face of the tension ring when the guides are present.

Figure 9:
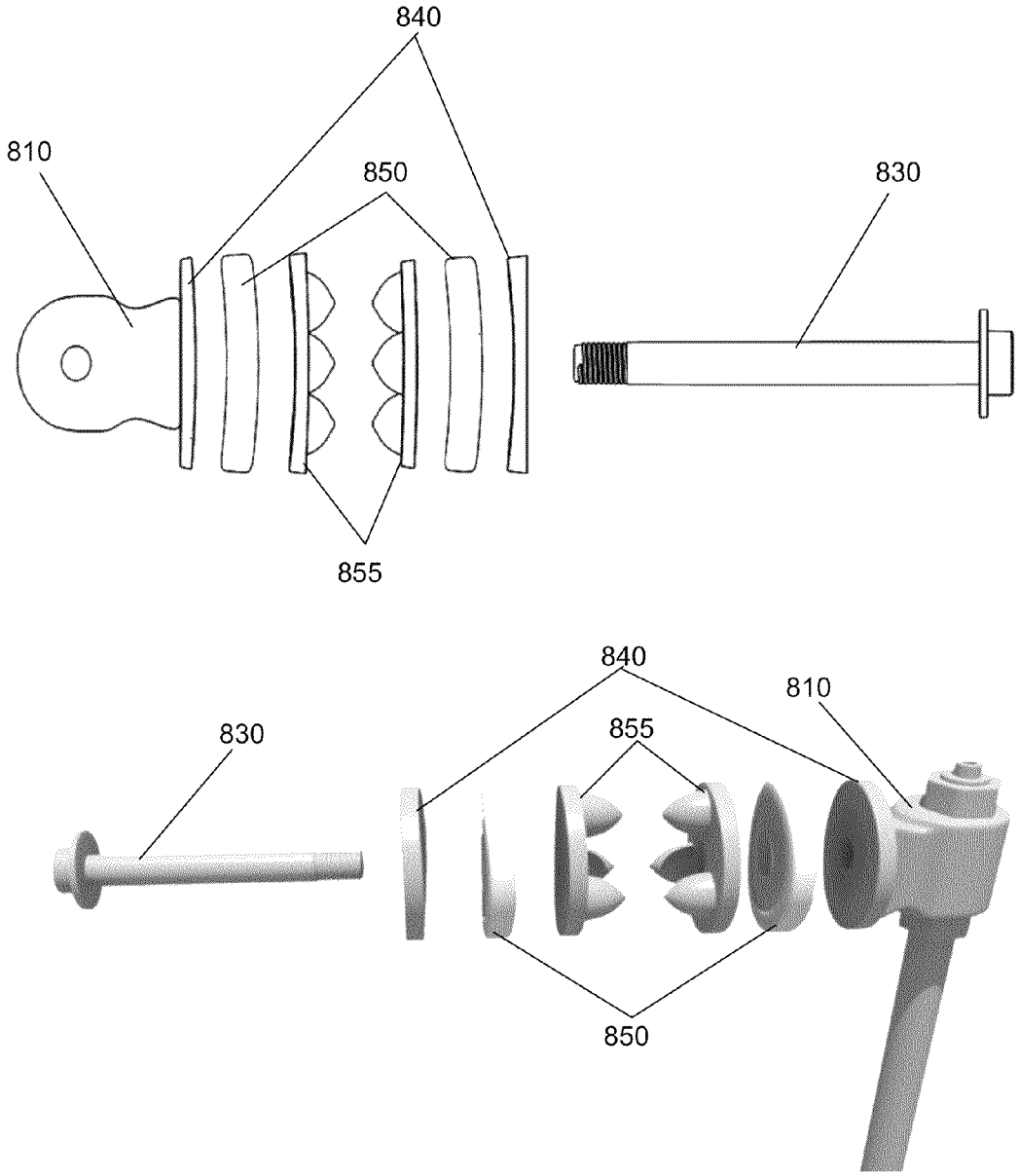
FIG. 9 provides another exploded view for the vibration dampening assembly of some embodiments.
Figure 10:
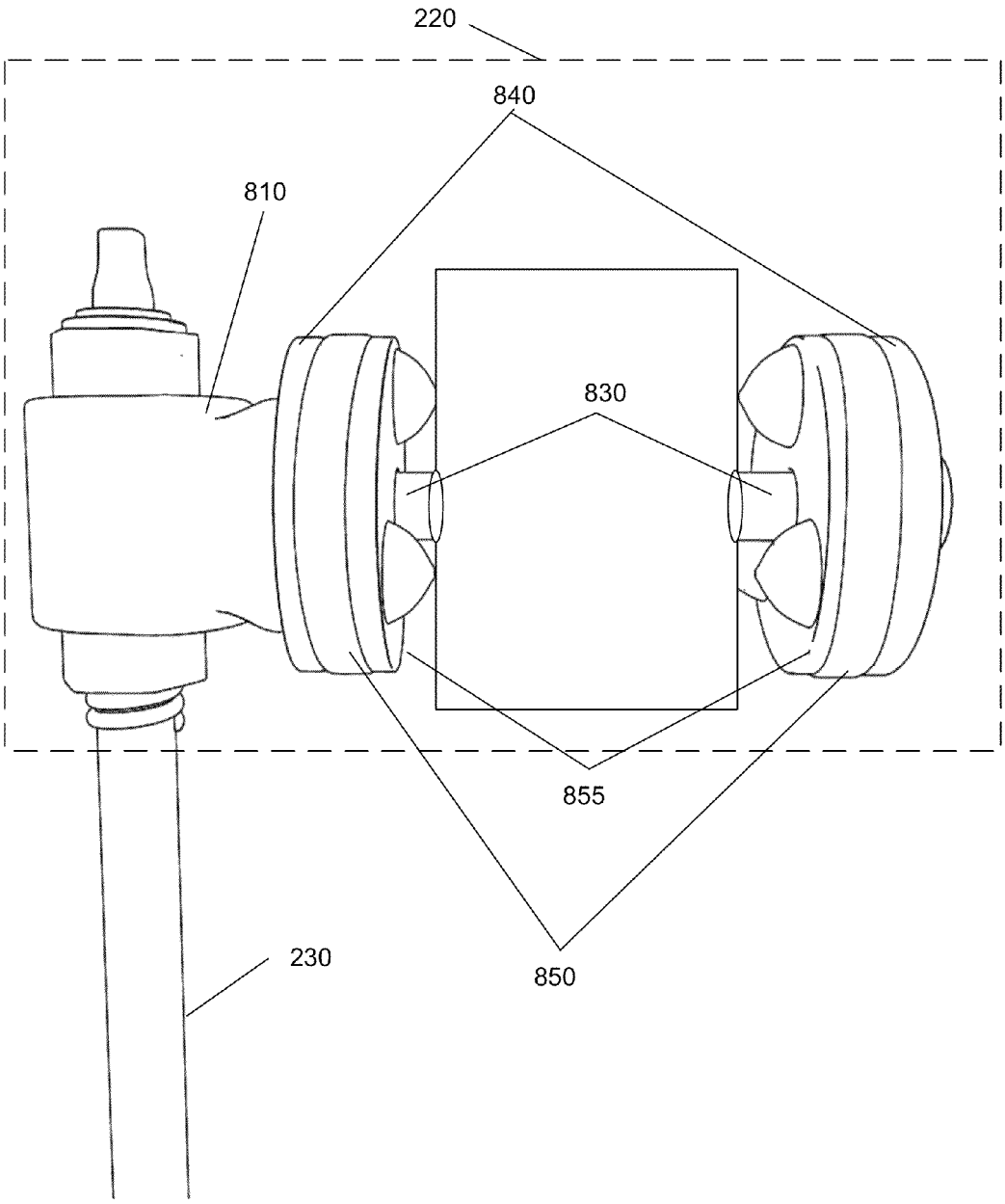
FIG. 10 illustrates a completed vibration dampening assembly.
Figure 11:
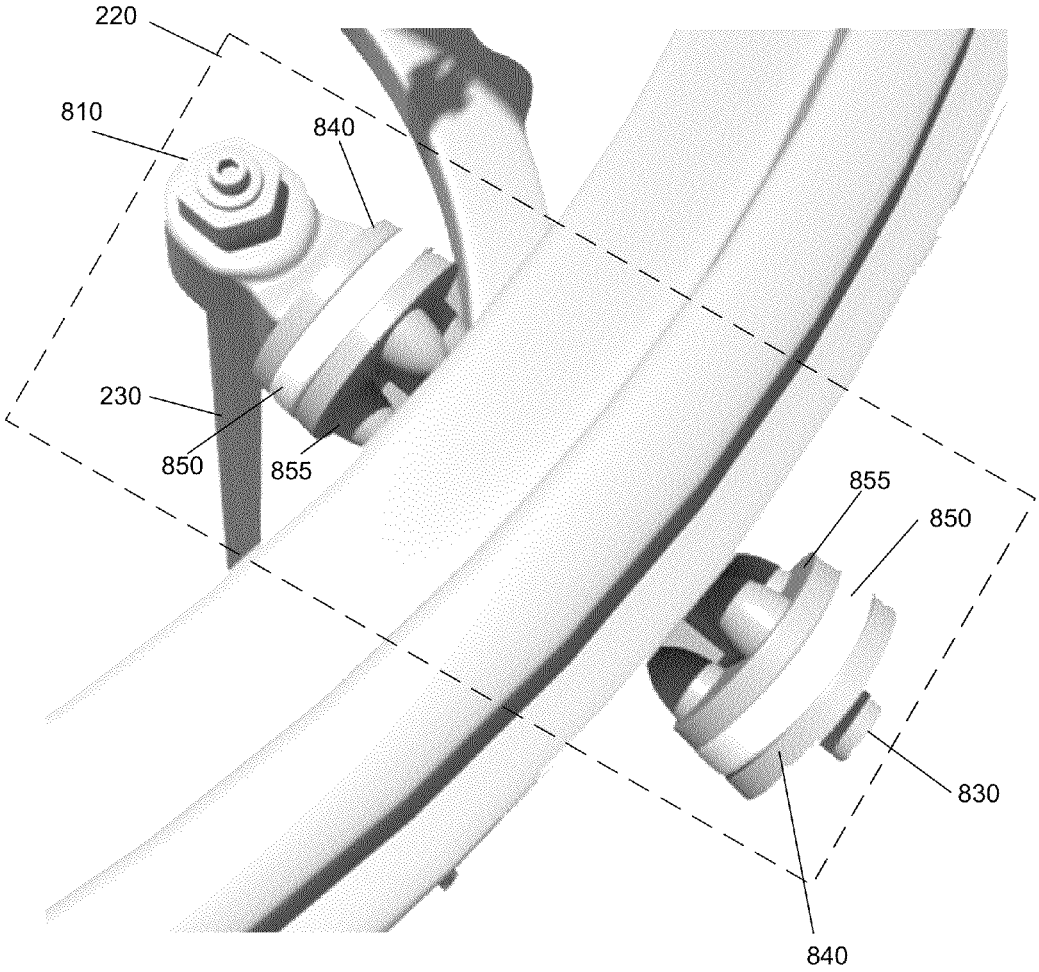
FIG. 11 provides an alternate rendering for a completed vibration dampening assembly secured to one of the shell mounts in accordance with some embodiments.

FIG. 9 provides another exploded view for the bolt 830, spacers 840, dampener 850, and gripped endcaps 855 that comprise the vibration dampening assembly 815 of the rod holders 220. FIG. 10 illustrates a completed vibration dampening assembly secured to one of the shell mounts 210 or 240. FIG. 11 provides an alternate rendering for a completed vibration dampening assembly secured to one of the shell mounts 210 or 240 in accordance with some embodiments.

Figure 12:
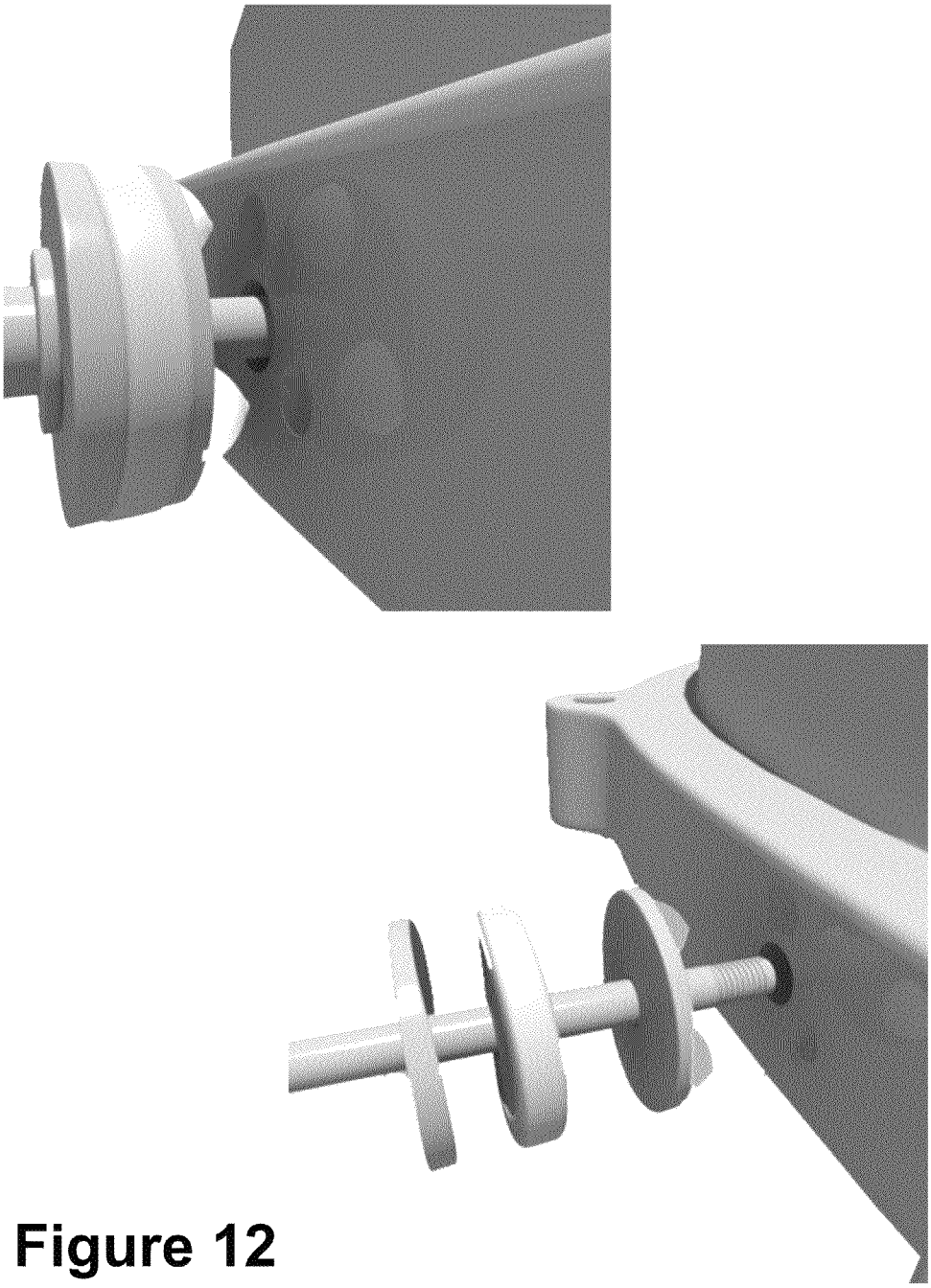
FIG. 12 provides two views illustrating an oversized tension ring aperture in accordance with some embodiments.

In some embodiments, the aperture of the tension ring is slightly larger than the bolt 830. The additional spacing in the tension ring aperture allows air to escape when the drum is struck, thereby providing venting and improved resonance. In some embodiments, the circumferential face of FIG. 12 provides two views illustrating an oversized tension ring aperture in accordance with some embodiments.

Figure 13:
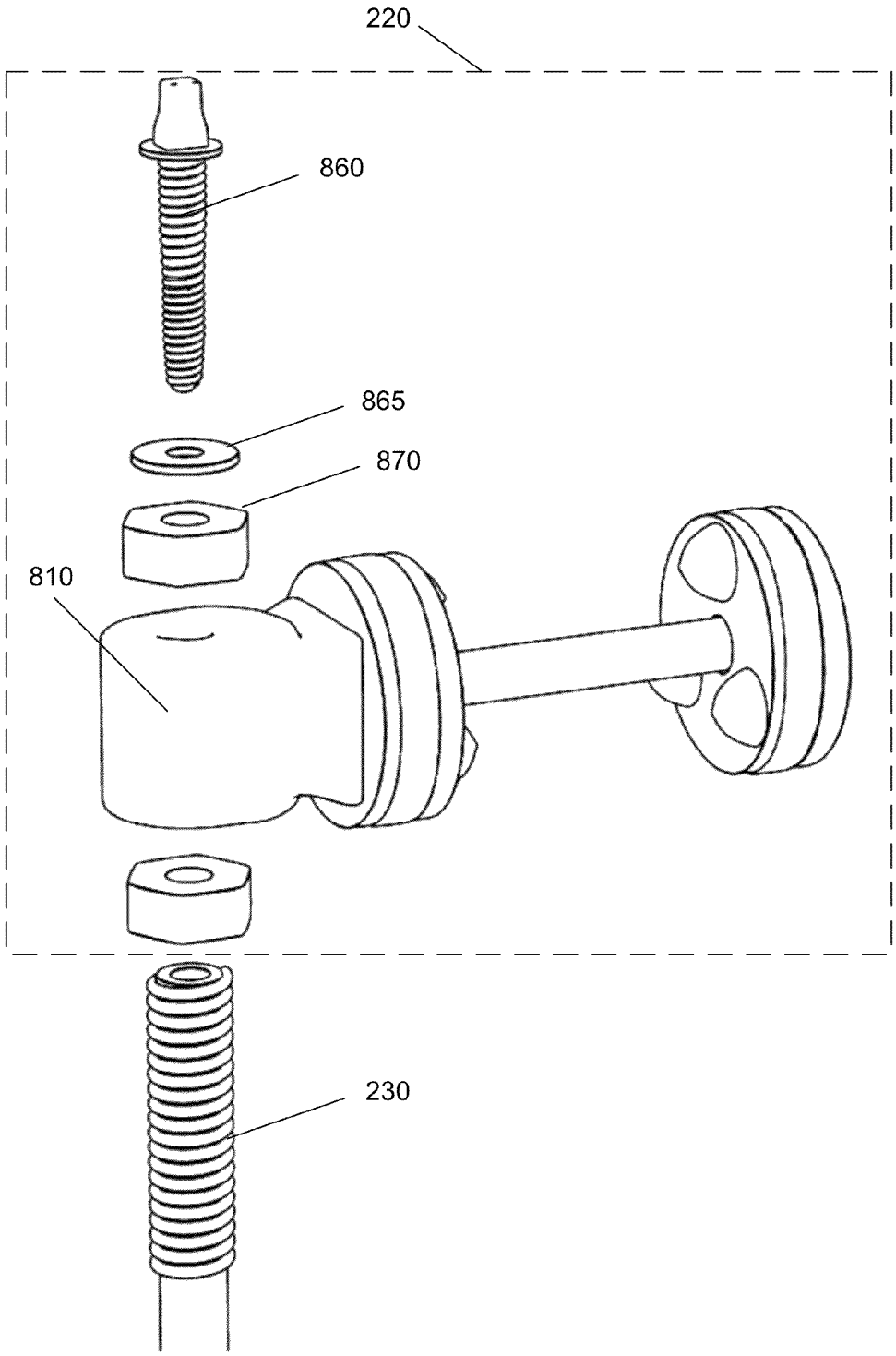
FIG. 13 illustrates an exploded view for the tension assembly of some embodiments.
Figure 14:
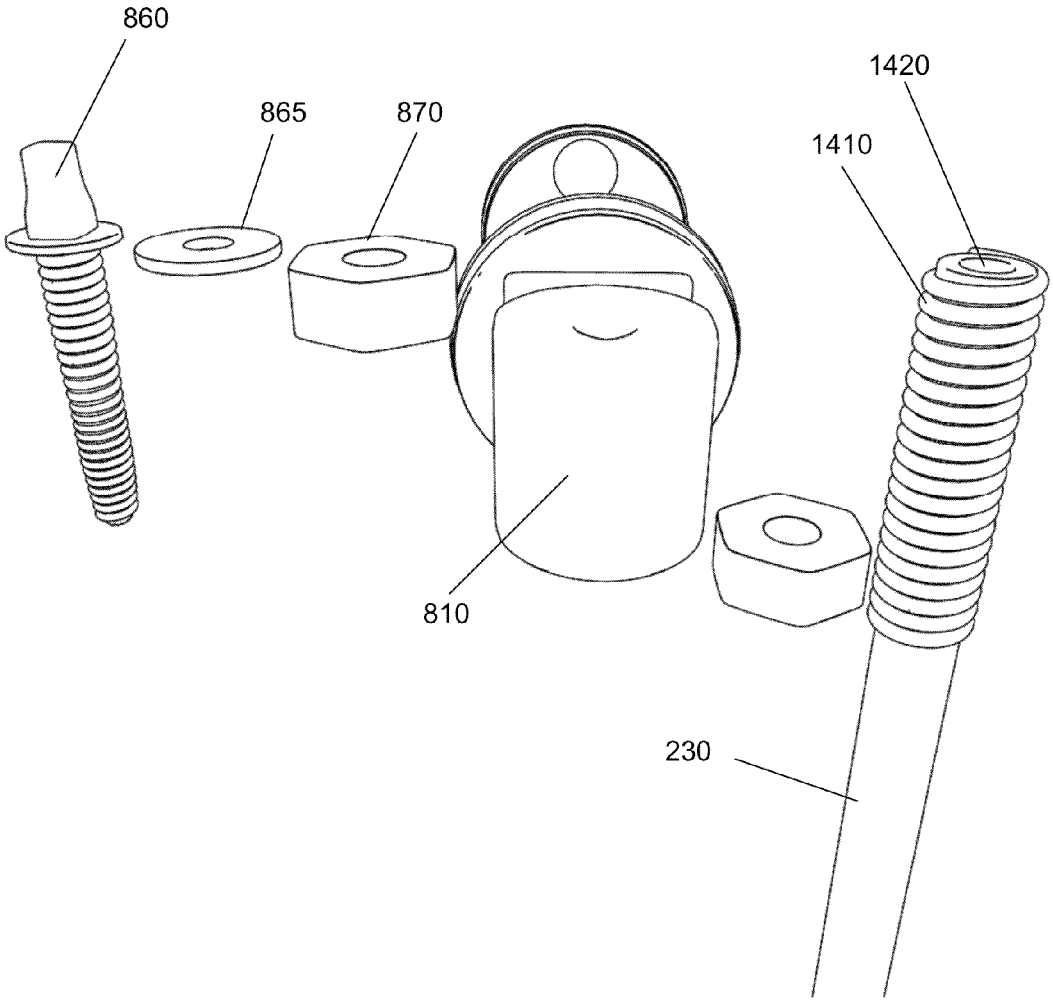
FIG. 14 provides an alternative staggered exploded view for the tension assembly of some embodiments.

With reference back to FIG. 8, the tension assembly 820 is comprised of top bolt 860, washer 865, and a threaded nut 870. FIG. 13 illustrates an exploded view for the tension assembly 820 of some embodiments. FIG. 14 provides an alternative staggered exploded view for the tension assembly 820 of some embodiments. The tension assembly 820 operates in conjunction with the three faceted binding anchor 810 and a tension rod 230 to secure the drum shell between the top shell mount 210 and the bottom shell mount 240 of the ultimount.

In some embodiments, each tension rod 230 is a hollowed shaft that contains an exterior thread and an interior thread at either end of the rod. In some embodiments, the tension rods 230 are made from metal, carbon fiber, or other rigid materials. Reference marker 1410 of FIG. 14 illustrates the exterior thread and reference marker 1420 points to the location of the interior thread. This configuration creates a two stage male-female coupling mechanism with which the tension rod 230 attaches and is secured to the anchor 810.

To complete the first stage of the male-female coupling mechanism, the exterior threaded end of the tension rod 230 screws through a first threaded nut 880, passes through a vertical aperture of the anchor 810, and is then secured at the other end of the anchor 810 with a second threaded nut 870. Completion of the first stage provides a loose coupling of the tension rod 230 to the anchor 810, thereby securing the tension rod 230 to the shell mount that the rod holder for the anchor is coupled to. The other exterior threaded end of the tension rod 230 is similarly secured to a rod holder that is coupled to the opposing shell mount using a complimentary second threaded nut 870. When the nuts 870 are tightened, the distance separating the shell mounts 210 and 240 is reduced, thereby compressing the drum shell disposed between the mounts 210 and 240. In some embodiments, the tension rod 230 can be screwed via nut 870 such that the end of the tension rod 230 is at least four centimeters away from the top of the anchor, thereby allowing for the distance between the two linked shell mounts 210 and 240 to differ by a total of eight centimeters. The distance separating the shell mounts 210 and 240 and the desired compression forced placed on the drum shell disposed in between can be specifically dialed using a torque wrench to tighten the nut 870. This customizability optimizes the ultimount framework for drum shells of different materials. For instance, the ultimount framework can be used with more brittle drum shells, such as those made of glass, by lessening the compression force on that shell, but the ultimount framework can also be used with more rigid drum shells, such as those made of wood, by increasing the compression force on that type of shell material.

Once the desired distance between the mounts 210 and 240 is achieved and a desired compression force is imposed on the drum shell using the second threaded nut 870 and the tension rod 230, the top bolt 860 of the tension assembly 820 is then used to lock the position of the second threaded nut 870 relative to the tension rod 230. The exterior thread of the top bolt 860 screws into the interior thread of the tension rod 230, thereby completing the second stage of the male-female coupling mechanism. Specifically, the top bolt 860 passes through the washer 865 and screws into the tension rod 230 until the endcap of the top bolt 860 presses underside of the washer 865 against the top of the second threaded nut 870. In so doing, the top bolt 860 prevents vibrations from altering the position of the second threaded nut 870 on the tension rod 230, thereby maintaining the distance separating the shell mounts 210 and 240 and, as a result, the compression force imposed on the drum shell by the coupling of the shell mounts using the tension rods 230 and the tension assembly 820. The washer 865 can be of varying thickness to enable the top bolt 860 to tighten when there is a gap in space between the second threaded nut 870 and the top bolt 865.

In some embodiments, the ultimount structure and design is adapted to incorporate different elements in addition to or instead of those described above. For example, in some embodiments, the tension rods can comprise shafts with only exterior threads, thereby eliminating the need for the top bolt 860.

As evident from the figures, the ultimount design only subjects the drum shell to a compression force based on the contact between the drum shell and the top 210 and bottom 240 shell mounts. In other words, the drum shell is subject to a y-axial force. However, there are no x-axial forces placed on the drum shell. Any such x-axial forces are placed on the top 210 and bottom 240 shell mounts based on the coupling of the rod holders 230 to the shell mounts. By removing the x-axial forces from the shell, the ultimount structural framework can be mounted on shells constructed from thinner materials than would normally be required for traditional drum mounts. Specifically, the ultimount structural framework supports drum shells made primarily of plastic, clay, or glass. These materials have different resonate properties than traditional wood, steel, or brass shells. Consequently, the ultimount opens the door to a new evolution in drum sound.

I claim:

1. A musical instrument comprising:

a top shell mount comprising an outer edge with a first plurality of horizontally facing openings;

a bottom shell mount comprising an outer edge with a second plurality of horizontally facing openings;

a plurality of anchor assemblies, each anchor assembly comprising (i) an anchor block with a horizontal cavity and a vertical cavity, (ii) a pair of vibration absorbing dampeners, and (iii) a bolt, wherein an anchor block horizontally couples to the outer edge at least one of the top shell mount and the bottom shell mount by positioning the pair of vibration absorbing dampeners along either side of a horizontal facing opening of the outer edge, by inserting the bolt through the pair of vibration absorbing dampeners, and by securing an end of the bolt into the horizontal cavity of the anchor block; and a plurality of rods, each rod comprising threads on both ends and configured to secure to a vertical cavity of a first anchor block that is coupled to the top shell mount and a vertical cavity of a second anchor block that is coupled to the bottom shell mount and that is aligned with the first anchor block, wherein a distance separating the top shell mount and the bottom shell mount is configurable based on a depth with which the plurality of rods secure into the vertical cavity.

2. The musical instrument of claim 1, wherein each anchor assembly further comprises an endcap having a plurality of protrusions, the endcap positioned between a vibration absorbing dampener and the horizontal facing opening of the outer edge with the plurality of protrusions abutting the outer edge.

3. The musical instrument of claim 1, wherein the top shell mount further comprises a bearing edge groove for holding an interchangeable bearing edge.

4. The musical instrument of claim 3 further comprising a plurality of bearing edges that are each cut at different angles, each bearing edge angle providing different tonality for the musical instrument when inset within the bearing edge groove.

5. The musical instrument of claim 1 further comprising a shell disposed between the top shell mount and the bottom shell mount and wherein sound produced by resonance of the shell is configurable by adjusting the depth with which the plurality of rods secure into the vertical cavity.

6. The musical instrument of claim 1, wherein the plurality of rods link the top shell mount to the bottom shell mount along an outer face of the outer edge of each shell mount.

7. The musical instrument of claim 1, wherein the plurality of rods link the top shell mount to the bottom shell mount along an inner face of the outer edge of each shell mount.

8. A mounting and tuning system for a musical drum, the mounting and tuning system comprising:

a top shell mount configured to mount over a first edge of a drum shell;

a bottom shell mount configured to mount over a second opposite edge of the drum shell;

a plurality of anchors horizontally coupling to a circumferential face of one of the top shell mount and the bottom shell mount, each anchor comprising a vertical aperture;

a plurality of tension rod couplers; and a plurality of tension rods, each with a proximal end and a distal end, wherein the proximal end passes through the vertical aperture of an anchor that is coupled to the bottom shell mount and is secured with a first tension rod coupler, and wherein the distal end passes through the vertical aperture of an anchor that is coupled to the top shell mount and is secured with a second tension rod coupler, wherein a sound characteristic of the drum is adjusted by turning in one direction either of the first and second tension rod couplers to pull the corresponding tension rod further through the vertical aperture thereby imposing greater compression on a drum shell disposed between the top shell mount and the bottom shell mount.

9. The mounting and tuning system of claim 8 further comprising a plurality of bearing edge rings each with a bearing edge of a different angle, and wherein the top shell mount comprises an upper ring and a lower ring with a groove for retaining any one of the plurality of bearing edge rings.

10. The mounting and tuning system of claim 9, wherein a second sound characteristic of the drum is adjusted by inserting a bearing edge ring having a bearing edge with a desired angle into said groove, placing a drumhead over the bearing edge, placing the upper ring over the drumhead, and securing the upper ring to the lower ring.

11. The mounting and tuning system of claim 8, wherein the top shell mount contains a first drumhead, and wherein the bottom shell mount contains a second drumhead that produces a different sound than the first drumhead when played.

12. A framework for customizing drum sound, the framework comprising:

a plurality of bearing edges cut at different angles and providing a first customization of the drum sound;

a top shell mount configured to mount atop a first edge of a drum shell, the top shell mount comprising (i) a groove receiving any of the plurality of bearing edges and (ii) a drumhead situated over a bearing edge that is inset in said groove, wherein the angle of the bearing edge inset within the groove provides a first customization of the drum sound by modifying energy transfer from the drumhead to the drum shell;

a bottom shell mount for mounting atop a second edge of the drum shell that is opposite to the first edge;

a plurality of tension rods spanning at least a length of the drum shell; and a plurality of holders, each holder of the plurality of holders comprising:

(i) an anchor with a vertically oriented opening and a horizontally oriented opening, (ii) a bolt for coupling said holder to one of the top shell mount and bottom shell mount by passing an opening along a circumferential face of one of the top shell mount and the bottom shell mount and securing to the horizontally oriented opening of said anchor; and (iii) a tension rod coupler providing a second customization of the drum sound by adjusting a distance separating the top shell mount from the bottom shell mount, wherein adjusting the distance comprises coupling the tension rod coupler to an end of a tension rod that is passed through the vertically oriented opening, turning the tension rod coupler in a first direction to decrease the distance, and turning the tension rod coupler in a second opposite direction to increase the distance.

13. The framework of claim 12, wherein turning the tension rod coupler in the first direction to decrease the distance increases compression of the drum shell, and wherein turning the tension rod coupler in the second direction to increase the distance decreases compression of the drum shell.

14. The framework of claim 12, wherein a first bearing edge of the plurality of bearing edges is cut at a 30 degree angle and a second bearing edge of the plurality of bearing edges is cut at a 45 degree angle.

15. The framework of claim 12, wherein a first bearing edge of the plurality of bearing edges is cut at an angle providing a rounded edge and a second bearing edge of the plurality of bearing edges is cut at an angle providing a pointed edge.

16. The framework of claim 12, wherein each tension rod of the plurality of tension rods comprises a first end with an exterior thread and a second end with an exterior thread.

17. The framework of claim 16, wherein the tension rod coupler comprises a nut that screws onto the exterior thread.

18. The framework of claim 12, wherein each tension rod of the plurality of tension rods comprises a first end having an exterior thread and an interior thread and a second end having an exterior thread and an interior thread.

19. The framework of claim 18, wherein the exterior thread for the first end of a particular tension rod passes through a first end of the vertically oriented opening and is secured by a nut at a second opposite end of the vertically oriented opening, and wherein the tension rod coupler comprises a bolt that passes from the second end through the nut and screws into the interior thread for the first end of the particular coupler to lock the nut in place.

20. The framework of claim 12, wherein the top shell mount further comprises a lower ring with said groove and an upper ring, and wherein the drumhead is secured by placing the upper ring over the drumhead and securing the upper ring to the lower ring.

* * * * *